US007066565B2

(12) United States Patent
Kitahara

(10) Patent No.: US 7,066,565 B2
(45) Date of Patent: Jun. 27, 2006

(54) LIQUID JETTING METHOD AND LIQUID JETTING APPARATUS USING THE METHOD

(75) Inventor: Tsuyoshi Kitahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/816,770

(22) Filed: Mar. 26, 2001

(65) Prior Publication Data

US 2001/0038398 A1 Nov. 8, 2001

(30) Foreign Application Priority Data

Mar. 24, 2000 (JP) ..... P.2000-083790
Jul. 21, 2000 (JP) ..... P.2000-220110

(51) Int. Cl.
*B41J 29/38* (2006.01)

(52) U.S. Cl. ..... 347/10; 347/11; 347/12

(58) Field of Classification Search ..... 347/68, 347/72, 9, 10, 12, 15, 11, 14, 5
See application file for complete search history.

(56) References Cited

U.S. PATENT DOCUMENTS 4,521,786 A * 6/1985 Bain ..... 346/140
5,363,134 A * 11/1994 Barbehenn et al. ..... 347/49
5,790,139 A 8/1998 Umeno et al. ..... 347/10
5,877,786 A * 3/1999 Sekiya et al. ..... 347/15
6,024,438 A * 2/2000 Koike et al. ..... 347/43
6,060,113 A * 5/2000 Banno et al. ..... 427/78
6,145,949 A * 11/2000 Takahashi ..... 347/14

FOREIGN PATENT DOCUMENTS

| | | | |
|---|---|---|---|
| EP | 0 605 216 A2 | | 7/1994 |
| EP | 0 827 838 A2 | | 3/1998 |
| EP | 0 963 844 A1 | | 12/1999 |
| JP | 0827838 | * | 3/1998 |
| JP | 11-58704 | | 3/1999 |
| JP | 11-277744 | | 10/1999 |
| JP | 3106104 | | 9/2000 |

* cited by examiner

*Primary Examiner*—Hai Pham
*Assistant Examiner*—Lam S. Nguyen
(74) *Attorney, Agent, or Firm*—Sughrue Mion, PLLC

(57) ABSTRACT

A liquid jetting head includes a plurality of nozzle orifices, a plurality of pressure generation chambers associated with the nozzle orifices, and a plurality of piezoelectric vibrators for respectively varying the volume of the associated pressure generation chamber to jet a liquid droplet from the associated nozzle orifice. A drive signal generator generates a plurality of drive signals, respectively driving the piezoelectric vibrators, within a single jetting cycle of the liquid jetting head. An ID data storage stores ID data which identifies the respective nozzle orifices. A correction data storage stores correction data which corrects the amount of liquid jetted from the nozzle orifice. A drive signal supplier identifies a nozzle orifice in which the jetting amount is to be corrected, through use of the ID data, and selects at least one drive signal from the plural drive signals to adjust a displacement degree of a piezoelectric vibrator associated with the identified nozzle orifice, based on the correction data.

26 Claims, 12 Drawing Sheets

| MODE | JETTING VOLUME (PICOLITERS) | | | | |
|---|---|---|---|---|---|
| | 36 | 37 | 38 | 39 | 40 |
| 1 | X | O | O | O | O |
| 2 | O | X | X | X | X |
| 3 | O | O | O | O | O |
| 4 | O | O | O | I | I |
| 5 | I | I | I | O | O |

| MODE | | | | | RELATIVE JETTING VOLUME |
|---|---|---|---|---|---|
| | I | ○ | ○ | | MEDIUM |
| | II | ○ | | ○ | SMALL |
| | III | | ○ | ○ | LARGE |

LIQUID JETTING METHOD AND LIQUID JETTING APPARATUS USING THE METHOD

BACKGROUND OF THE INVENTION

The present invention relates to a technique for jetting a very small amount of liquid as a droplet of specified volume to a plurality of areas from nozzle orifices.

An ink jet recording head capable of jetting a very small amount of liquid to a target position with relatively high accuracy is applied to a liquid jetting apparatus, such as a textile printing apparatus or a micro-dispenser.

In order to improve jetting efficiency, the number of nozzle orifices is increased. The amounts of liquid jetted from nozzle orifices by one operation are subjected to a maximum variation of ±10% approximately. In order to eliminate the variations, components constituting a recording head, such as nozzle orifices, a pressure generation chamber, and a pressure generator, must be manufactured with high accuracy, which in turn results in a significant upsurge in costs of a recording head to be used for an application of this type.

In order to prevent this problem, Japanese Patent No. 3,106,104 describes an ink jet head, in which a pressure generation chamber equipped with a heating element for generating thermal energy, as a droplet jetting member. In this patent, there is proposed formation of a drive signal by use of a pair of pulse signals; that is, a pre-heat pulse signal whose pulse width is adjustable, and a heat pulse signal whose pulse width is constant. The drive signal is supplied to the heating element. The temperature of liquid is adjusted by means of the pulse width of the pre-heat pulse signal, and a given volume of liquid is jetted in accordance with a heat pulse signal for jetting purpose. There is also described a method of rendering constant the pulse width of the pre-heat pulse signal and that of the heat pulse for jetting purpose, and of rendering variable the number of droplets to be jetted to a plurality of regions, thereby jetting liquid of uniform amount to the regions.

According to the related technique, the volume of liquid to be jetted can be controlled with practical precision by use of an ink jet head having specifications applied to a general-purpose apparatus. However, such a technique requires heating of liquid to its boiling point for jetting a droplet. Heating may degrade some types of liquid. Hence, limitations are imposed on the range of liquids to which the related technique is applicable. Further, the related technique requires the pre-heat pulse signal in addition to the heat pulse signal for jetting droplets, thereby complicating a control structure.

SUMMARY OF THE INVENTION

It is therefore an object of the present invention is to provide a droplet jetting method, which enables jetting of droplets of given volumes from a plurality of nozzle orifices without involvement of degradation of liquid, and by use of only drive signals.

Another object of the present invention is to provide a liquid jetting apparatus suitable for implementing the method.

In order to achieve the above objects, according to the present invention, there is provided a method of jetting liquid droplets, comprising the steps of:

providing a liquid jetting head which includes: a plurality of nozzle orifices; a plurality of pressure generation chambers associated with the nozzle orifices; and a plurality of piezoelectric vibrators for respectively varying the volume of the associated pressure generation chamber to jet a liquid droplet from the associated nozzle orifice;

providing ID data for identifying the respective nozzle orifices;

providing correction data for correcting the amount of liquid jetted from the nozzle orifice;

identifying a nozzle orifice in which the jetting amount is to be corrected, through use of the ID data; and adjusting a displacement degree of a piezoelectric vibrator associated with the identified nozzle orifice, based on the correction data.

In this configuration, a necessity of heating a liquid to be jetted can be eliminated. Further, nozzle orifices are specified by use of ID data. Waveforms of drive signals are elaborately set in accordance with the volumes of liquid to be jetted from respective nozzles, thereby correcting variations in the volume of liquid to be jetted from nozzle orifices with high accuracy by means of a displacement characteristic of a piezoelectric element. The piezoelectric element undergoes displacement in accordance with the voltage of a drive signal or the rate of change of the drive signal. Only drive signals to be used for jetting a droplet are required, and the volumes of pressure generation chambers can be adjusted precisely with use of only drive signals.

DETAILED DESCRIPTION OF THE PREFERRED EMBODIMENTS

Figure 1:
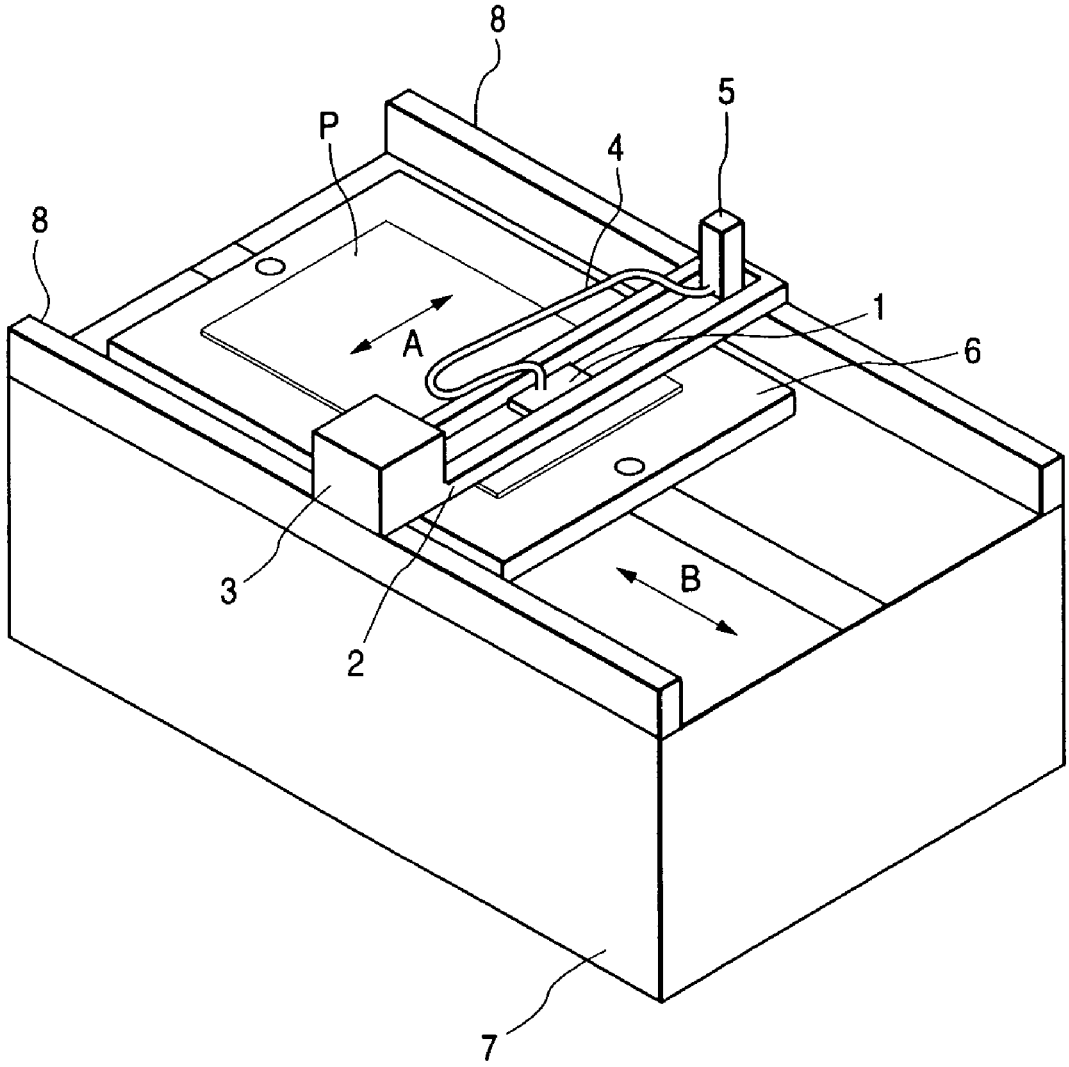
FIG. 1 is an illustration showing the overall construction of a liquid jetting apparatus.

FIG. 1 shows an example of a liquid jetting apparatus. A carriage 1, on which is mounted a recording head serving as a liquid jetting member to be described later, is constructed so as to be able to travel back and forth in the direction designated by arrow A, by means of an unillustrated drive motor housed in a mechanism chamber 3 formed with a frame 2. Liquid stored in a tank 5 can be supplied to a recording head by way of a flexible liquid supply tube 4.

A stage 6 is provided below the frame 2 for supporting an article to be coated P (hereinafter simply called "article P") such that the article P opposes nozzle orifices of the liquid jetting member. Each end of the stage 6 is provided on a corresponding guide member 8 provided on a base 7 so that the stage 6 can travel in the travel direction of the carriage 1 (the direction designated by arrow B).

Figure 2A:
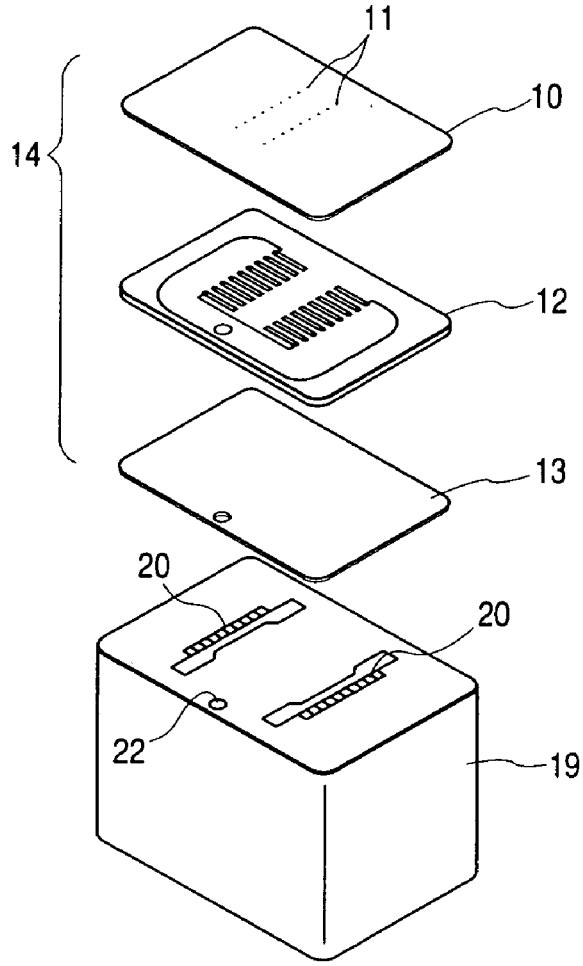
FIG. 2A is a perspective assembly view showing one example of a recording head used in the liquid jetting apparatus.
Figure 2B:
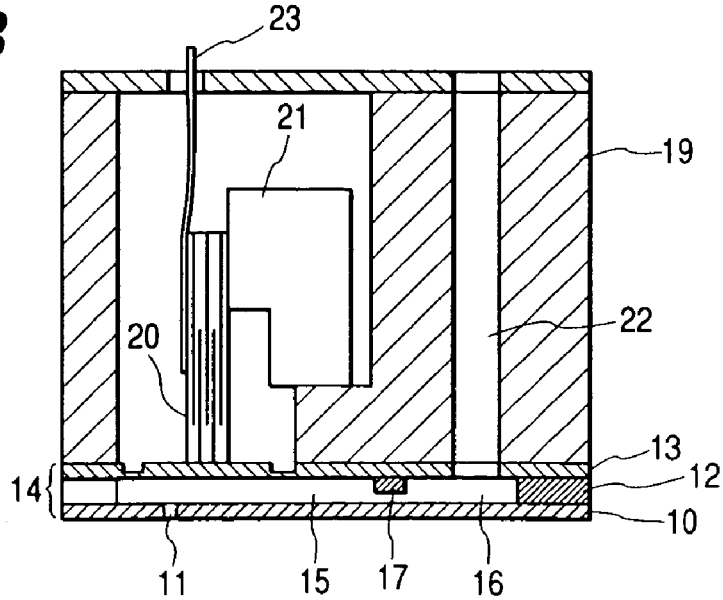
FIG. 2B is a cross-sectional view showing the recording head.

FIGS. 2A and 2B show an example of a recording head constituting the liquid jetting member. Recesses and through holes formed in a channel formation plate 12 are sealed with the nozzle plate 10, and the other surface of the channel formation plate 12 is sealed with an elastic plate 13. Accordingly, a pressure generation chamber 15 and a liquid reservoir 16, which are in communication with the nozzle orifices 11, are formed within the channel formation plate 12. Further, a liquid supply port 17 for interconnecting the pressure chamber 15 and the liquid reservoir 16 is also formed in the channel formation plate 12. A piezoelectric vibrator 20 which imparts expansion and contraction to the elastic plate 13 is housed in a holder 19.

In the present embodiment, the piezoelectric vibrator 20 is contracted in a charged state and expands when shifting from a charged state to a discharged state. The tip end of the piezoelectric vibrator 20 is in contact with the elastic plate 13 so as to oppose the pressure generation chamber 15, and the other end of the same is fixed to a base 21. Reference numeral 22 designates an inlet pipe for supplying liquid from the liquid supply tube 14 to the reservoir 16. Reference numeral 23 designates a flexible cable for supplying a drive signal to the piezoelectric vibrator 20.

Figure 3:
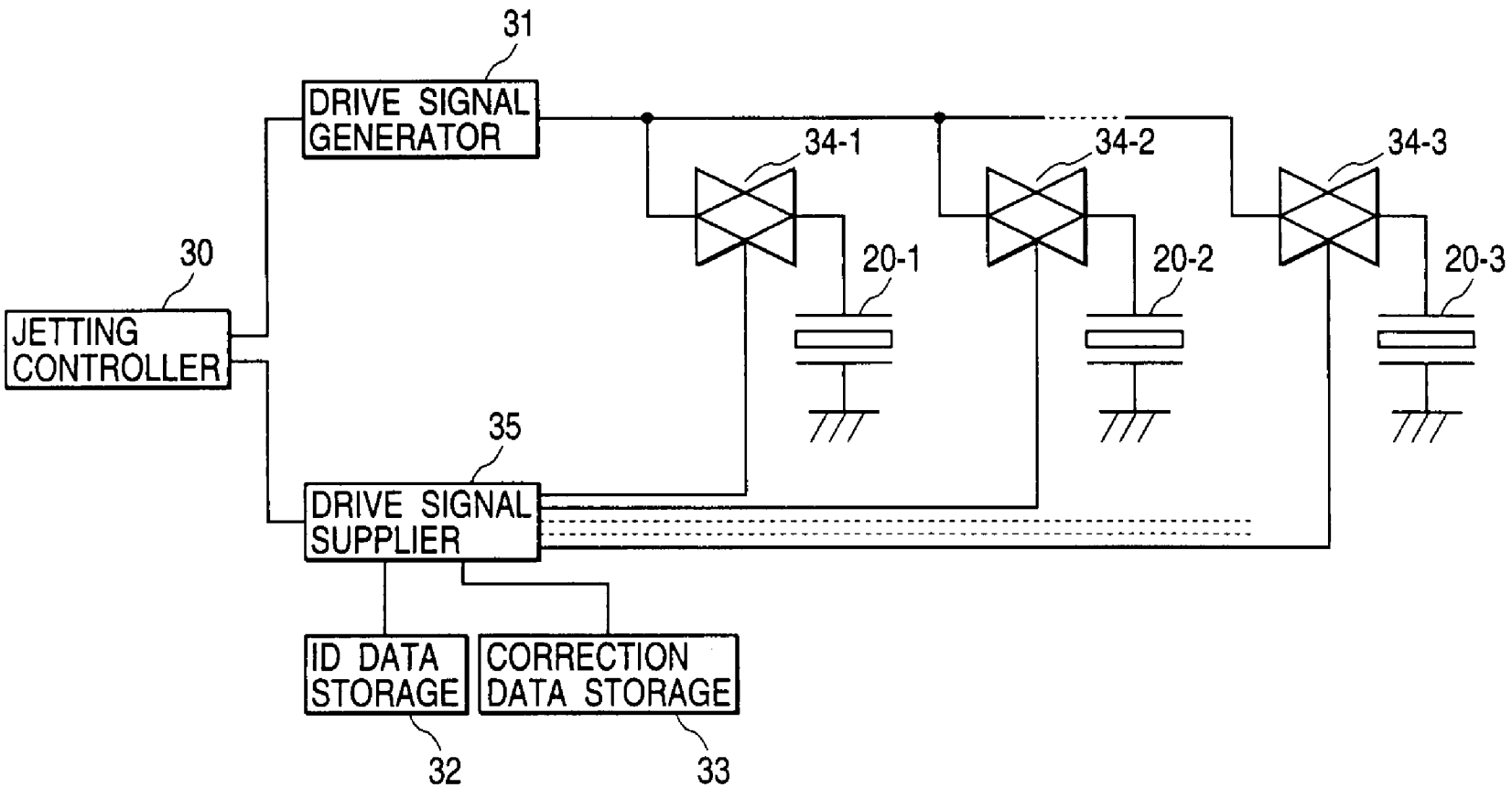
FIG. 3 is a block diagram showing one example of a driver for driving the recording head.

FIG. 3 shows an example of the liquid jetting apparatus. The liquid jetting apparatus comprises a jetting controller 30, a drive signal generator 31, and a drive signal supplier 35. The jetting controller 30 outputs a jetting instruction at a predetermined cycle in accordance with the relative position between an article to be subjected to jetting of liquid and a nozzle orifice of the recording head. The drive signal generator 31 outputs a plurality of types of drive signals to be described later to the piezoelectric vibrator 20, which changes the volume of the pressure generation chamber 15. The drive signal supplier 35 outputs signals for activating switchers 34-1 to 34-3, in order to apply optimal drive signals to the piezoelectric vibrators 20-1 to 20-3 corresponding to nozzle orifices from which droplets are to be jetted, by reference to data stored in an ID data storage 32 and a correction data storage 33.

Figure 4:
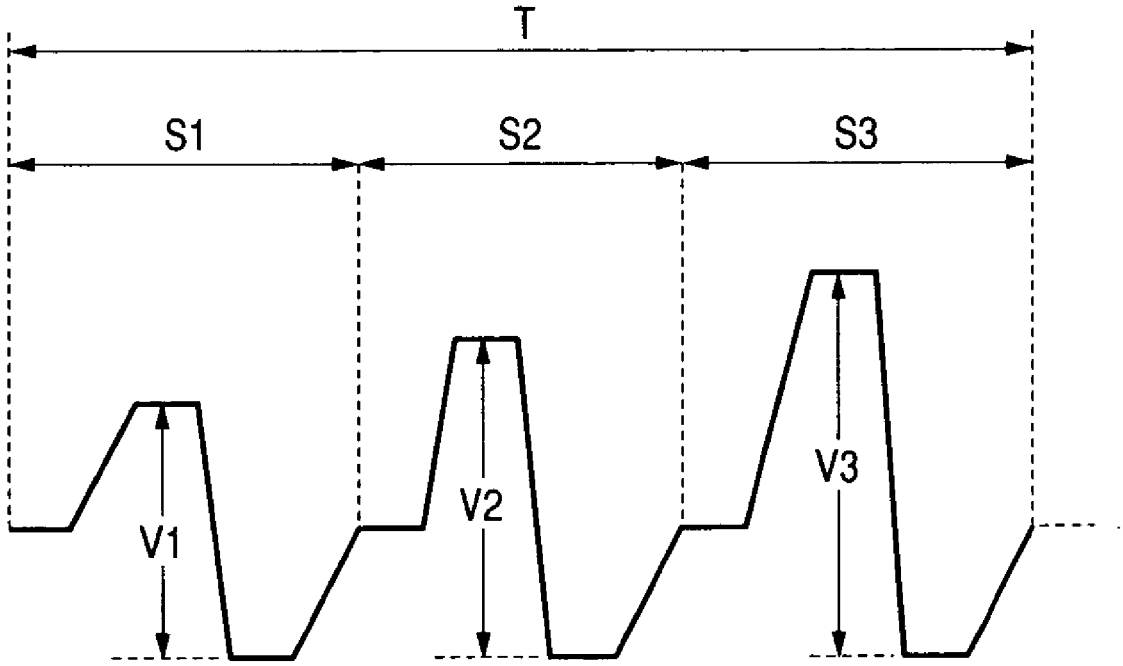
FIG. 4 is a waveform diagram showing a drive signal according to a first embodiment of the invention.

As shown in FIG. 4, the drive signal generator 31 according to a first embodiment of the invention is configured to output, at a given cycle, a plurality of types of signals; that is, three types of signals S1, S2, and S3, for changing the amount and pattern of displacement of the piezoelectric vibrator 20 during a single jetting cycle T.

The drive signal S2 is to be applied to a piezoelectric vibrator which jets a droplet of reference volume by one single jetting operation; e.g., 10 picoliters. The drive signal S1 is to be applied to a piezoelectric vibrator of a nozzle orifice which jets a droplet of larger volume; e.g., 10.5 picoliters. The drive signal S3 is applied to a piezoelectric vibrator which jets a droplet of smaller volume; e.g., 9.5 picoliters.

The drive signal S1 is set to a drive voltage V1, and the drive signal S3 is set to a drive voltage V3, wherein the drive voltages V1 and V3 differ from a drive voltage V2 of the reference drive signal S3. As a result, the drive energy applied to the piezoelectric vibrator becomes controllable. Even if variations are present in the characteristics of flow channels, such as nozzle orifices, as well as in the piezoelectric constant, and displacement characteristics of the piezoelectric vibrator 20, a droplet of substantially the reference volume can be jetted by a single operation, by means of selecting an appropriate one from the drive signals S1, S2, and S3.

If the drive signal is formed as a trapezoidal or triangular signal whose voltage changes with lapse of time, the energy required for the piezoelectric vibrator to jetting a droplet can be used for controlling applied pressure or the rate of change in volume, by means of changing not only the voltage of the drive signal but also a gradient of the voltage change.

The ID data storage 32 is configured so as to store ID data for identifying respective nozzle orifices 11 formed in the nozzle plate 10. The correction data storage 33 is configured so as to store data to be used for selecting one from the drive signals S1, S2, and S3 such that the volume of droplet to be jetted from the nozzle orifice specified by the ID data in one operation attains the reference volume.

In the present embodiment, the piezoelectric vibrators 20-1, 20-2, and 20-3 are activated by means of the reference drive signal S2, and the volumes of the resultant droplets are measured. If the measurement results show that a droplet of 10.5 picoliters is jetted from the nozzle orifice as a result of actuation of the piezoelectric vibrator 20-1, that a droplet of 10.0 picoliters is jetted from the nozzle orifice as a result of actuation of the piezoelectric vibrator 20-2, and that a droplet of 9.5 picoliters is jetted from the nozzle orifice as a result of actuation of the piezoelectric vibrator 20-3, instruction data are stored in the correction data storage 33 so as to correspond to the ID data to be used for specifying the nozzle orifices. By means of the instruction data, there is issued an instruction for applying the drive signal S1 to the piezoelectric vibrator 20-1, applying the drive signal S2 to the piezoelectric vibrator 20-2, and applying the drive signal S3 to the piezoelectric vibrator 20-3.

When a jetting instruction signal is input to the jetting controller 30 after completion of storage of correction data pertaining to all the nozzle orifices, the jetting controller 30 activates the drive signal generator 31, to thereby serially output the drive signals S1, S2, and S3 during the period of a single jetting cycle T.

Simultaneously, the drive signal supplier 35 is activated. As a result, on the basis of the data stored in the ID data storage 32 and the data stored in the correction data storage 33, the switcher 34-1 is activated at a point in time when the drive signal S1 is to be output. The switcher 34-2 is activated at a point in time when the drive signal S2 is to be output. Further, the switcher 34-3 is activated at a point in time when the drive signal S3 is to be output.

As a result, the piezoelectric vibrator 20-1 produces energy lower than the reference energy level, thereby jetting, by way of a discharge orifice, a droplet of 10.0 picoliters, which is smaller than a droplet of 10.5 picoliters which would be jetted when the reference signal S2 is applied. Further, the piezoelectric vibrator 20-3 jets a droplet of 10.0 picoliters, which is larger than a droplet of 9.5 picoliters which be jetted when the reference signal S2 is applied. In this way, a droplet of 10.0 picoliters (which is a reference volume) is jetted from all the nozzle orifices.

After jetting of droplets to predetermined locations has been completed, the article P is moved by means of actuating the carriage 1 or the stage 6. When the next jetting region has been set, the jetting controller 30 outputs the jet signal, thus repeating the foregoing processes.

Figure 5:
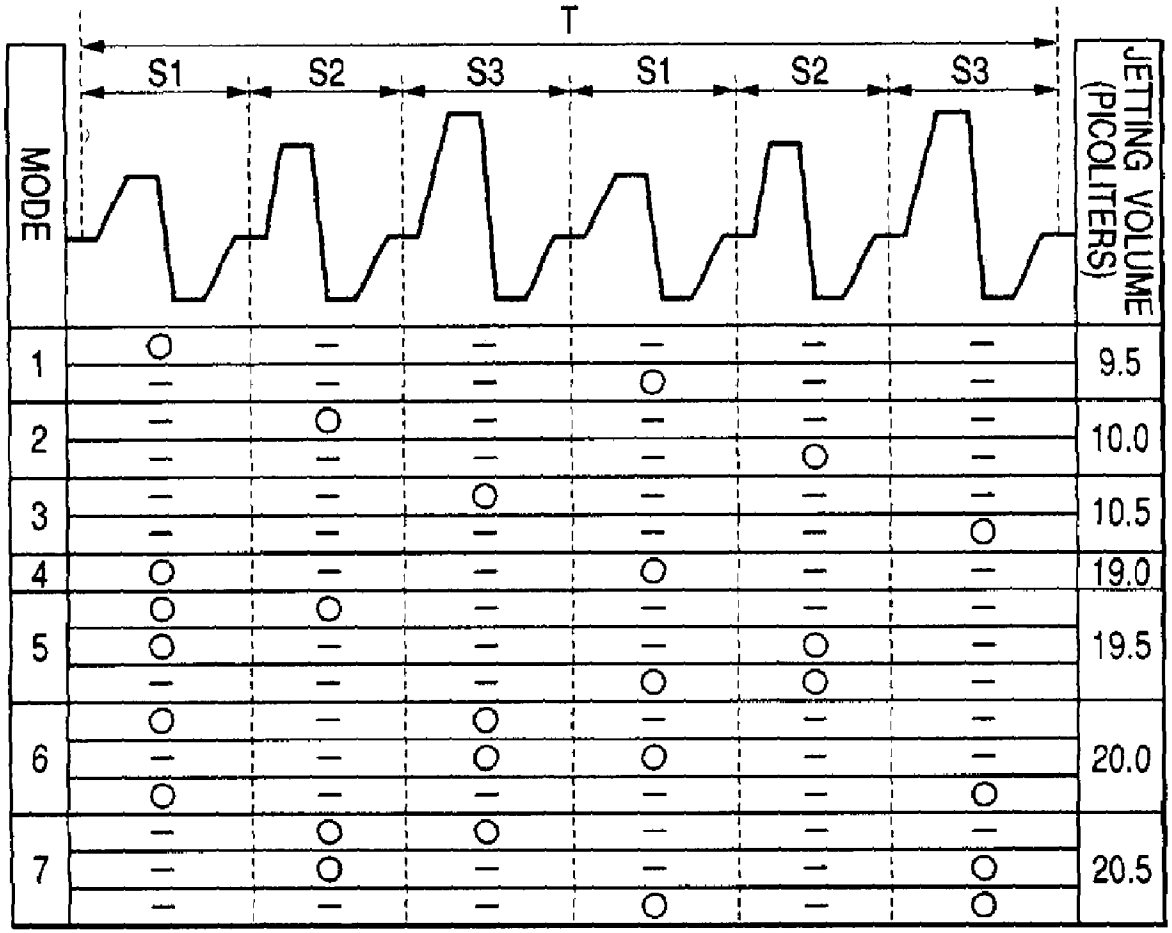
FIG. 5 is a waveform diagram showing a drive signal according to a second embodiment of the invention.

The embodiment has described a case where one droplet is jetted during one jetting cycle. As shown in FIG. 5, according to a second embodiment of the invention, the drive signals S1, S2, and S3 are taken as a single set at frequencies which prevent occurrence of interference between meniscuses, which would otherwise be caused by a plurality of drive signals. So long as the set of drive signals is repeated several times within a single jetting cycle T, large variations in the volume of liquid between nozzle orifices can be prevented.

Namely, setting a drive signal which is capable of jetting a liquid droplet having a volume smaller than a required liquid volume as a reference drive signal, finer volume adjustment of the liquid droplet to be jetted can be attained. In the case of FIG. 5 in which the required liquid volume is 20 picoliters, since each of the reference drive signals S1 to S3 is set as a drive signal capable of jetting a liquid droplet of 0.5 picoliters, the volume adjustment of jetted liquid droplet can be varied with 0.5 picoliters as a unit.

In this embodiment, there has been shown a case where 0.5 picoliters of volume adjustment unit with respect to 20 picoliters of desired liquid volume. Of course, more precise volume adjustment can be realized by setting a finer drive signal as the reference drive signal.

In other words, volume differences among the liquid droplets ejected by the respective drive signals can be divided by a volume of a liquid droplet which is the minimum volume jetted by one single drive signal. Namely, in a case where a plurality of drive signals are prepared, various amounts of volume differences can be obtained. In such a case, each of the differences is a specific amount which has been adjusted by the minimum volume jetted by the reference drive signal as a unit.

Figure 6:
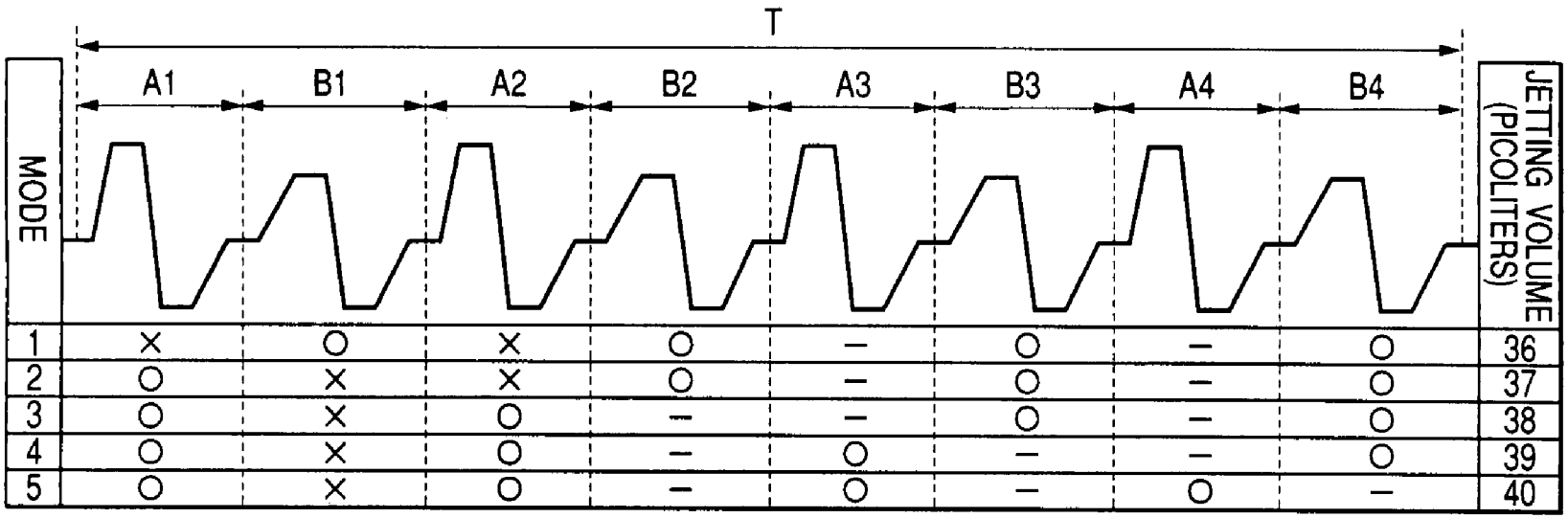
FIG. 6 is a waveform diagram showing a drive signal according to a third embodiment of the invention.

In the second embodiment, independent drive signals are applied to the pressure generator in accordance with the volume of liquid to be jetted from nozzle orifices. As shown in FIG. 6, according to a third embodiment of the invention, drive signals A and B, which differ in drive energy from each other and are taken as a pair, are generated several times as signals A-1 and B-1, . . . , A-4 and B-4 during a single jetting cycle T, such that movements of meniscuses are not stopped by the signals. Timings at which the drive signals are to be supplied to the piezoelectric vibrators are specified as modes 1 through 5. In connection with an example piezoelectric vibrator of a nozzle orifice which jets a reference droplet volume, the volume of droplet can be adjusted on a per-picoliter basis from 36 picoliters to 40 picoliters.

Provided that the reference droplet volume is taken as 38 picoliters, data are stored in the correction data storage 33 such that a drive signal is supplied, in Mode 5, to the piezoelectric vibrator of the nozzle discharge which jets only 36 picoliters. Further, data are stored in the correction data storage 33 such that a drive signal is supplied, in Mode 1, to the piezoelectric vibrator of the nozzle discharge which jets as much as 40 picoliters. Accordingly, variations in the volume of droplet between nozzle orifices can be corrected.

If a plurality of modes are dynamically selected within one jetting cycle T, there can be achieved correct control of volume of a single droplet to an arbitrary value, as well as correction of variations in the volume of droplets between the nozzle orifices.

Figure 7:
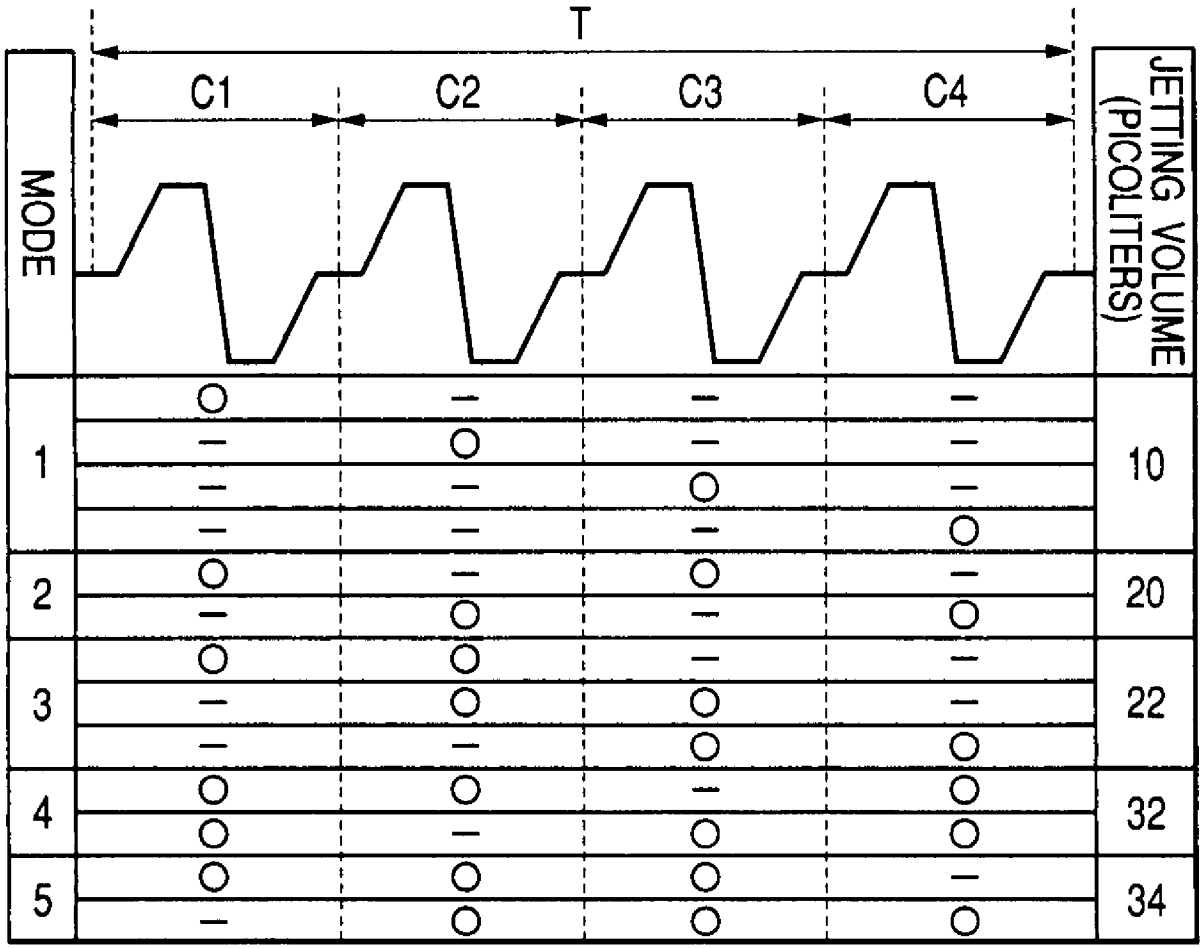
FIG. 7 is a waveform diagram showing a drive signal according to a fourth embodiment of the invention.

As shown in FIG. 7, according to a fourth embodiment, a plurality of drive signals of identical drive energy; that is, four signals in the embodiment, are produced within a single jetting cycle T at a given time interval at which motion of meniscuses is not stopped by the signals, and timings at which the drive signals are to be applied to the piezoelectric vibrator 20 are selected, thereby controlling the volume of liquid.

Figure 8A:
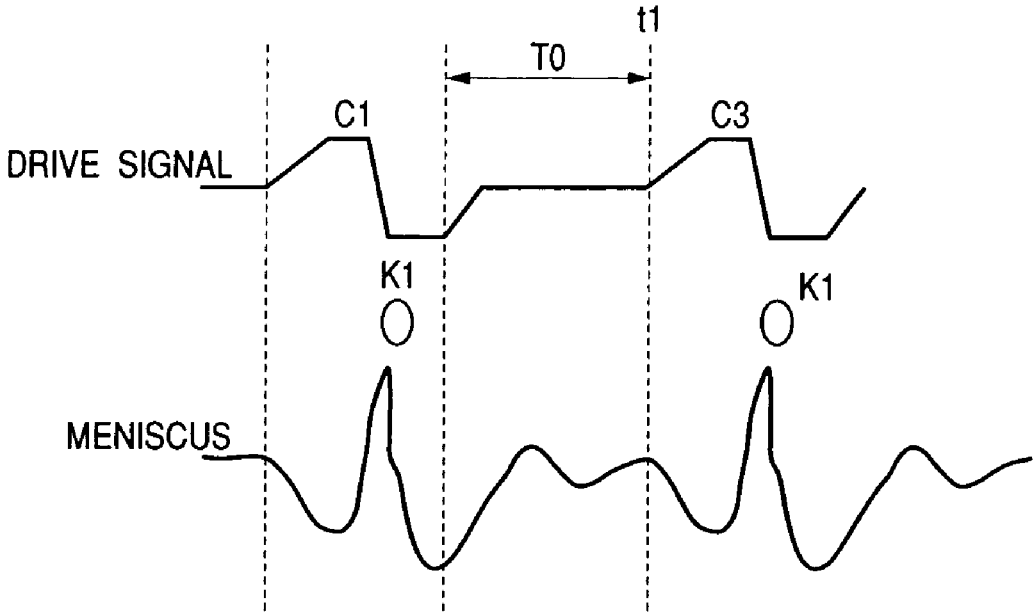
FIGS. 8A and 8B are diagrams for explaining variations in droplet volume realized by the fourth embodiment.
Figure 8B:
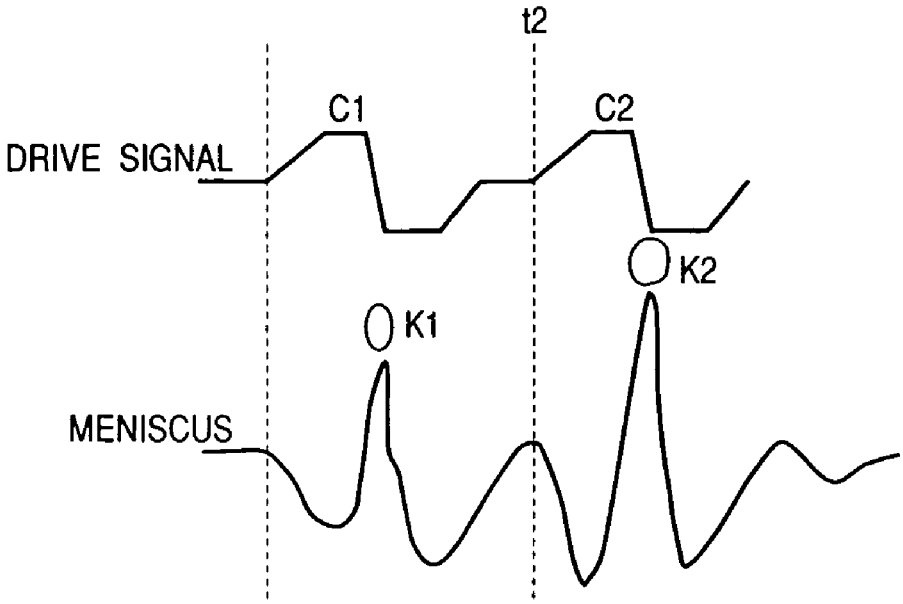

As in the case of Mode 2, in a case where the next drive signal C2 is applied to the piezoelectric vibrator at a point in time t1 at which time T0 during which a meniscus returns to a stationary state has already elapsed since jetting of an immediately preceding droplet, a droplet K1 equal to that jetted by an immediately-preceding drive signal C1 is jetted, as shown in FIG. 8A. In contrast, as in the case of Mode 3, if the next drive signal C2 is applied to the piezoelectric vibrator at a point in time t2 at which the meniscus actuated by the immediately-preceding jetting action returns toward the pressure generation chamber, the kinetic energy of the meniscus which has jetted a droplet is superimposed on the drive energy of the drive signal. Because of this, the meniscus causes large motion, thereby resulting in an increase in the volume of droplet K2 to be jetted.

Figure 9:
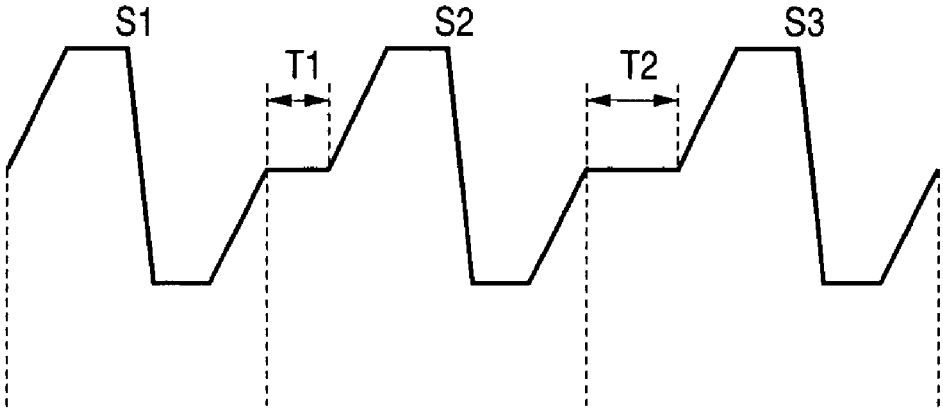
FIG. 9 is a waveform diagram showing a drive signal according to a fifth embodiment of the invention.
Figure 10A:
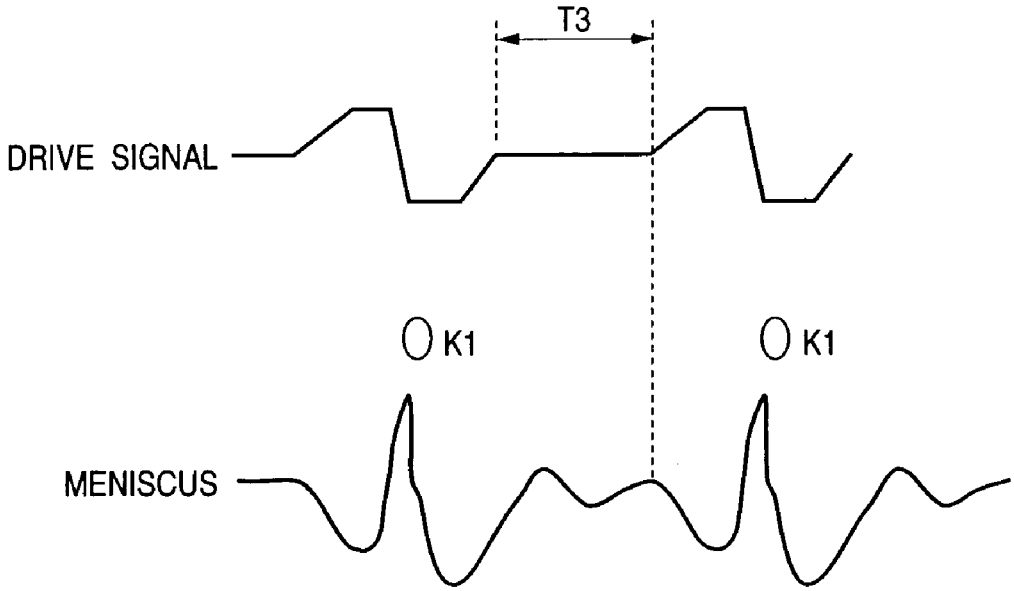
FIGS. 10A and 10B are diagrams for explaining variations in droplet volume realized by the fifth embodiment.
Figure 10B:
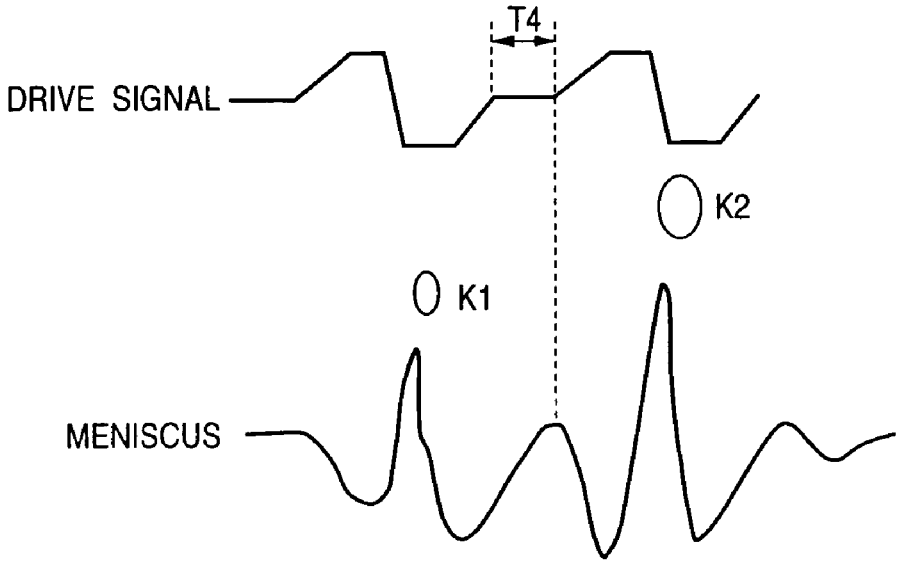

FIG. 9 shows a drive signal according to a fifth embodiment. Here, the drive signal generator 31 is configured to output three drive signals S1, S2, and S3 of identical waveform to the piezoelectric vibrator 20 during a single jetting cycle T while time intervals T1 and T2 between the drive signals are changed. As shown in FIGS. 10A and 10B, jetting of a droplet causes vibration in a meniscus, and the vibration undergoes displacement with lapse of time. Hence, the position of the meniscus at a point in time at which the next droplet is to be jetted changes with time. For this reason, if a time from when an immediately-preceding droplet has been jetted is set, the position of the meniscus at a point in time when the next droplet is to be jetted is changed. As mentioned above, a droplet K1 becomes different in volume from a droplet K2.

As shown in FIG. 10A, when the next signal is applied after lapse of time T3 during which vibration of a meniscus stemming from jetting of an immediately-preceding droplet travels toward the nozzle orifice, two droplets, each being identical with the droplet K1 jetted at the time of application of a single drive signal, can be jetted. As shown in FIG. 10B, when the next signal is applied after lapse of time T4 during which vibration of the meniscus stemming from jetting of an immediately-preceding droplet travels toward the nozzle orifice, a droplet K2, which is greater in volume than the droplet K1 jetted at the time of application of a single drive signal, can be jetted.

Stored in the correction data storage 33 are data to be used for selecting any two signals from the drive signals S1, S2, and S3 for making the volume of droplet to be jetted from a nozzle orifice specified by ID data during one operation equal to the reference volume.

In this configuration, the reference drive signal; e.g., the signal S1, is applied twice to each of the piezoelectric vibrators 20-1, 20-2, and 20-3 with a time interval which would not affect the motion of a meniscus. The volume of the two droplets jetted from each of the nozzle orifices is measured. The measurement results are assumed to show that a droplet of 21.0 picoliters is jetted from the nozzle orifice as a result of activation of the piezoelectric vibrator 20-1, that a droplet of 20.0 picoliters is jetted from the nozzle orifice as a result of activation of the piezoelectric vibrator 20-2, and that a droplet of 19.0 picoliters is jetted from the nozzle orifice as a result of activation of the piezoelectric vibrator 20-3.

On the basis of the measurement results and in correspondence to the ID data pertaining to the nozzle orifices, data are stored in the correction data storage 33 such that the drive signals S1 and S3 are applied to the piezoelectric vibrator 20-1, the drive signals S1 and S2 are applied to the piezoelectric vibrator 20-2, and the drive signals S2 and S3 are applied to the piezoelectric vibrator 20-3.

As a result, when a jetting instruction signal is input, the jetting controller 30 activates the drive signal generator 31, thereby serially outputting the drive signals S1, S2, and S3 during a single jetting cycle T. Simultaneously, the drive signal supplier 35 is activated. On the basis of the data stored in the ID data storage 32 and the data stored in the correction data storage 33, the switchers 34-1 and 34-2 are turned on at a point in time when the drive signal S1 is output; the switchers 34-2 and 34-3 are turned on at a point in time when the drive signal S2 is output; and the switchers 34-1 and 34-3 are turned on at a point in time when the drive signal S3 is output.

As a result, the piezoelectric vibrator 20-1 jets a droplet without use of the effect of increasing the volume of a droplet resulting from vibration of a meniscus for jetting a droplet in response to the signal S1. The piezoelectric vibrator 20-2 jets a droplet of 21.0 picoliters. The droplet is slightly greater in volume than a droplet of 20.0 picoliters which is jetted by means of independent application of the signal S2 twice while making slight use of the vibration of the meniscus for jetting a droplet in response to the signal S1. Further, the piezoelectric vibrator 20-3 jets a droplet of 21.0 picoliters, which is greater in volume than the droplets jetted as a result of two independent applications of the signal S1 while actively utilizing the motion of the meniscus. This is because the drive signal S3 is applied at a point in time when the vibration of the meniscus stemming from jetting of a droplet in response to the drive signal travels toward the nozzle orifice.

As a result, all the nozzle orifices can jetting identical volumes of liquid, regardless of variations in elements which determine the volume of a droplet to be jetted, such as a piezoelectric vibrator, a nozzle orifice, and a pressure chamber.

Figure 11A:
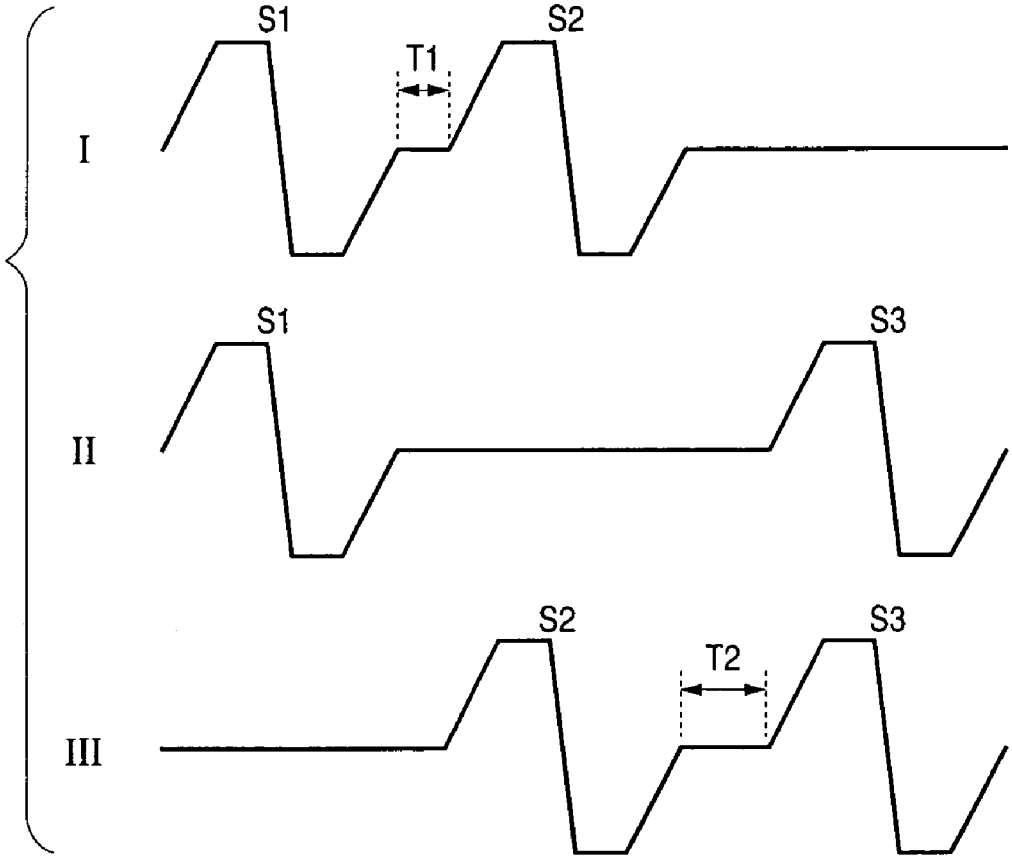
FIG. 11A is a waveform diagram showing a drive signal according to a sixth embodiment of the invention.

In the above embodiments, the drive signals S1, S2, and S3 output from the drive signal generator 31 are selected by the drive signal supplier 35, as required, and the thus-selected signals are applied to the piezoelectric vibrator. However, according to a sixth embodiment of the invention, the same advantageous result can be attained even when the drive signal generator 31 has prepared beforehand three signals I, II, and III having time intervals T1 and T2 set therein, as shown in FIG. 11A, and when the drive signal supplier 35 selects one from the signals I, II, and III and applies the thus-selected signal to the piezoelectric vibrator.

Figure 11B:
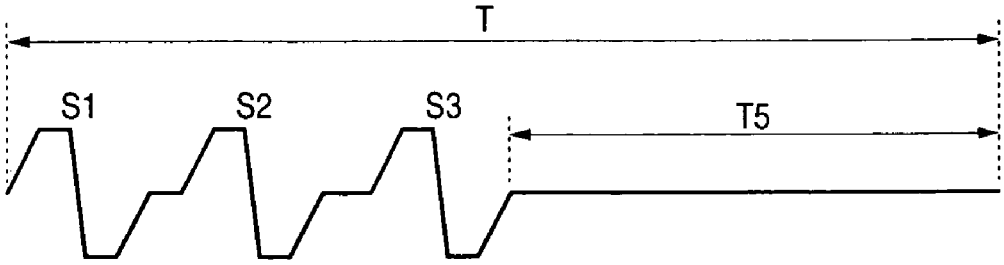
FIG. 11B is a waveform diagram showing a drive signal according to a seventh embodiment of the invention.

Further, according to a seventh embodiment of the invention, as shown in FIG. 11B, there is set one jetting cycle T, including time T5 which starts from the end of the drive signal S3 to be finally output, and during which vibration of a meniscus stemming from jetting of a droplet in response to the signal S3 dissipates. As a result, the volume of liquid can be controlled more precisely and without involvement of instability of a meniscus due to a preceding jetting cycle.

Even if one jetting cycle T is set longer, when the liquid jetting apparatus is used for application purpose, deterioration of working efficiency can be prevented by utilization of a time required for effecting relative motion of the article P as the time period T5.

In the above embodiments, the three drive signals S1, S2, and S3 are prepared for one jetting cycle, and a maximum of two of them are applied to the piezoelectric vibrator. However, even when only one drive signal may be selected, the same advantageous result can be attained. Further, it is obvious that the same advantageous result can be attained by adjusting the drive signal generation timings so that N (here N is an integer of three or more) drive signals can be applied during a single jetting cycle T; selecting M (where M is an integer smaller than N) of the N drive signals; and outputting the thus-selected M signals.

Figure 12A:
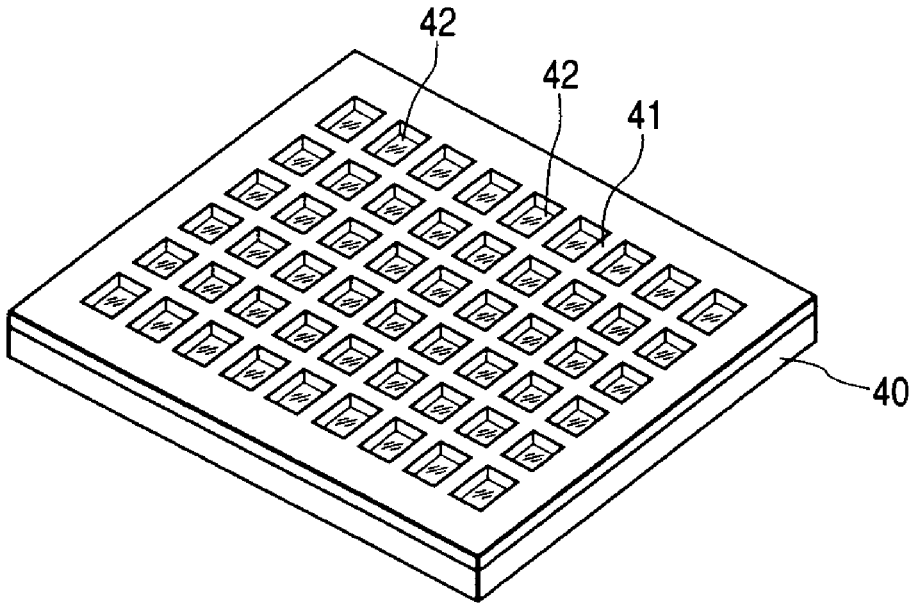
FIG. 12A is a perspective view showing an example article to be coated by use of the liquid jetting apparatus.
Figure 12B:
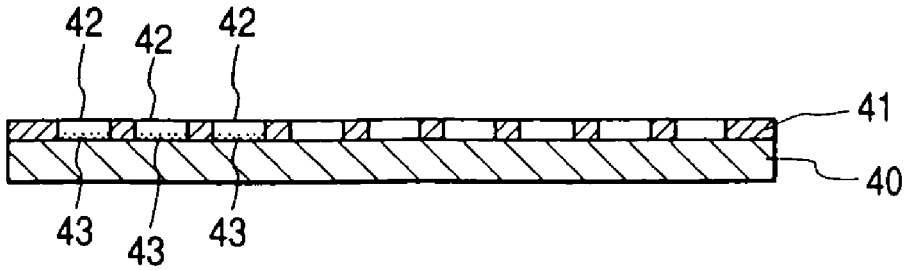
FIG. 12B is a cross-sectional view showing the article.

Such a liquid jetting apparatus is optimal for producing a filter by volatilizing solvent contained in a specified volume of liquid pigment 43, which is poured into regions 42 partitioned by a bank member 41 formed on the surface of a substrate 40, as shown in FIGS. 12A and 12B.

The previous embodiments have described a case where liquid droplets are supplied to a member to be coated. Needless to say, predetermined high-quality images or characters can be printed on a print medium while ink is used as a liquid.

What is claimed is:

1. A method jetting liquid droplets, comprising the steps of:

providing a liquid jetting head which includes: a plurality of nozzle orifices; a plurality of pressure generation chambers associated with the nozzle orifices; and a plurality of piezoelectric vibrators for respectively varying the volume of the associated pressure generation chamber to jet a liquid droplet from the associated nozzle orifice;

providing ID data for identifying the respective nozzle orifices;

providing a reference drive signal to instruct the piezoelectric vibrator to jet a reference liquid droplet having a designated amount from the nozzle orifice;

applying the reference drive signal to the respective piezoelectric vibrators to jet liquid droplet from the nozzle orifices;

measuring amounts of the respective liquid droplets jetted from the respective identified nozzle orifices by the reference drive signal;

identifying a difference between the designated amount and the measured amount of each liquid droplet;

providing correction data for reducing the difference so that the designated amount is jetted from the nozzle orifice;

associating the correction data with the respective nozzle orifices identified by the ID data;

storing the associated correction data;

providing a plurality of serial drive signals for driving the piezoelectric vibrators to jet liquid droplets from the nozzles;

selecting at least one drive signal from the plurality of serial drive signals to adjust a displacement behavior of a piezoelectric vibrator associated with the identified nozzle orifice, based on the associated correction data; and applying the selected drive signal to the piezoelectric vibrators.

2. The liquid jetting method as set forth in claim 1, wherein the at least one drive signal within a single jetting cycle of the jetting head is selected in the selecting step; and wherein the plurality of drive signals respectively have different liquid jetting energy from each other.

3. The liquid jetting method as set forth in claim 1, further comprising the step of identifying a nozzle orifice in which the jetting amount is to be corrected, through use of the ID data.

4. The liquid jetting method as set forth in claim 1, wherein the identified nozzle orifice ejects the liquid in accordance with the displacement behavior of the piezoelectric vibrator when the identified nozzle orifice receives print data.

5. The liquid jetting method as set forth in claim 1, wherein the selected serial drive signals are applied at different intervals within the single jetting cycle.

6. The liquid jetting method as set forth in claim 5, wherein the intervals are determined such that a phase of residual vibration of a meniscus of the liquid in the nozzle orifice is adjusted due to jetting by a preceding drive signal.

7. A method of jetting liquid droplets, comprising the steps of:

providing a liquid jetting head which includes: a plurality of nozzle orifices; a plurality of pressure generation chambers associated with the nozzle orifices; and a plurality of piezoelectric vibrators for respectively varying the volume of the associated pressure generation chamber to jet a liquid droplet from the associated nozzle orifice;

setting a single jetting cycle as a period in which N serial drive signals are applicable to the piezoelectric vibrators to jet liquid droplets from the nozzle orifices, N being an integer;

providing ID data for identifying the respective nozzle orifices;

providing a reference drive signal to instruct the piezoelectric vibrator to jet a reference liquid droplet having a designated amount from the nozzle orifice;

applying the reference drive signal to the respective piezoelectric vibrators to jet liquid droplets from the nozzle orifices;

measuring amounts of the respective liquid droplets jetted from the respective identified nozzle orifices by the reference drive signal;

identifying a difference between the designated amount and the measured amount of each liquid droplet;

providing correction data for reducing the difference so that the designated amount is jetted from the nozzle orifice;

associating the correction data with the respective nozzle orifices identified by the ID data; and storing the associated correction data;

selecting M drive signals from the N serial drive signals based on the associated correction data, M being an integer which is equal to or less than N, where N>1; and applying the M drive signals to the piezoelectric vibrators within the single jetting cycle.

8. The liquid jetting method as set forth in claim 7, wherein the selected drive signals are applied at different intervals within the single jetting cycle.

9. The liquid jetting method as set forth in claim 8, wherein the intervals are determined such that a phase of residual vibration of a meniscus of the liquid in the nozzle orifice is adjusted due to jetting by a preceding drive signal.

10. The liquid jetting method as set forth in claim 7, further comprising the step of identifying a nozzle orifice in which the jetting amount is to be corrected, through use of the ID data.

11. The liquid jetting method as set forth in claim 7, wherein the identified nozzle orifice ejects the liquid in accordance with a displacement behavior of the piezoelectric vibrator when the identified nozzle orifice receives print data.

12. The liquid jetting method as set forth in claim 7, wherein the serial drive signals respectively have different liquid jetting energy from each other.

13. A liquid jetting apparatus, comprising:

a liquid jetting head including: a plurality of nozzle orifices; a plurality of pressure generation chambers associated with the nozzle orifices; and a plurality of piezoelectric vibrators for respectively varying the volume of the associated pressure generation chamber to jet a liquid droplet from the associated nozzle orifice;

a drive signal generator, for generating a plurality of serial drive signals, respectively driving the piezoelectric vibrators, within a single jetting cycle of the liquid jetting head;

an ID data storage, for storing ID data which identifies the respective nozzle orifices;

a reference drive signal generator, for generating a reference drive signal to instruct the piezoelectric vibrator to jet a reference liquid droplet having a designated amount from the nozzle orifice;

a reference drive signal applier, for applying the reference drive signal to the respective piezoelectric vibrators to jet liquid droplet from the nozzle orifices;

an identifier, for measuring amounts of the respective liquid droplets jetted from the respective identified nozzle orifices by the reference drive signal, and identifying a difference between the designated amount and the measured amount of each liquid droplet;

a correction data storage, for storing correction data which reduces the difference so that the designated amount is jetted from the nozzle orifice, and the correction data associated with the respective nozzle orifices identified by the ID data; and a drive signal supplier, for selecting at least one drive signal from the serial drive signals to adjust a displacement behavior of a piezoelectric vibrator associated with the identified nozzle orifice, based on the associated correction data.

14. The liquid jetting apparatus as set forth in claim 13, wherein the drive signal supplier selects at least two drive signals from the plural drive signals.

15. The liquid jetting apparatus as set forth in claim 13, wherein the drive signal supplier identifies a nozzle orifice in which the jetting amount is to be corrected, through use of the ID data.

16. The liquid jetting apparatus as set forth in claim 13, wherein the identified nozzle orifice is operably configured to eject liquid in accordance with the displacement behavior of the piezoelectric vibrator when the identified nozzle orifice receives print data.

17. The liquid jetting method as set forth in claim 13, wherein the serial drive signals respectively have different liquid jetting energy from each other.

18. The liquid jetting method as set forth in claim 13, wherein the selected serial drive signals are applied at different intervals within the single jetting cycle.

19. The liquid jetting method as set forth in claim 18, wherein the intervals are determined such that a phase of residual vibration of a meniscus of the liquid in the nozzle orifice is adjusted due to jetting by a preceding drive signal.

20. A liquid jetting apparatus, comprising:

a liquid jetting head including: a plurality of nozzle orifices; a plurality of pressure generation chambers associated with the nozzle orifices; and a plurality of piezoelectric vibrators for respectively varying the volume of the associated pressure generation chamber to jet a liquid droplet from the associated nozzle orifices;

at least one drive signal generator, for generating N serial drive signals, respectively driving the piezoelectric vibrators, within a single jetting cycle of the liquid jetting head, N being an integer which is not less than 3;

an ID data storage, for storing ID data which identifies the respective nozzle orifices;

a reference drive signal generator, for generating a reference drive signal to instruct the piezoelectric vibrator to jet a reference liquid droplet having a designated amount from the nozzle orifice;

a reference drive signal applier, for applying the reference drive signal to the respective piezoelectric vibrators to jet liquid droplets from the nozzle orifices;

an identifier, for measuring amounts of the respective liquid droplets jetted from the respective identified nozzle orifices by the reference drive signal, and identifying a difference between the designated amount and the measured amount of each liquid droplet;

a correction data storage, for storing correction data which reduces the difference so that the designated amount is jetted from the nozzle orifice, and the correction data associated with the respective nozzle orifices identified by the ID data; and a drive signal supplier, for identifying a nozzle orifice in which the jetting amount is to be corrected, through use of the ID data, and selecting M drive signals from the N serial drive signals to adjust a displacement behavior of a piezoelectric vibrator associated with the identified nozzle orifice, based on the associated correction data, M being an integer which is equal to or less than N.

21. The liquid jetting apparatus as set forth in claim 20, wherein the selected drive signals are applied at different intervals within the single jetting cycle.

22. The liquid jetting method as set forth in claim 21, wherein the intervals are determined such that a phase of residual vibration of a meniscus of the liquid in the nozzle orifice is adjusted due to jetting by a preceding drive signal.

23. The liquid jetting apparatus as set forth in claim 20, wherein the single jetting cycle is determined as a period which is enough to substantially damp residual vibration of a meniscus of the liquid in the nozzle orifice due to jetting by the last drive signal within the single jetting cycle.

24. The liquid jetting apparatus as set forth in claim 20, wherein a plurality of drive signal generators are provided such that different drive signals are generated from the respective drive signal generators.

25. The liquid jetting apparatus as set forth in claim 20, wherein the identified nozzle orifice is operably configured to eject liquid in accordance with the displacement behavior of the piezoelectric vibrator when the identified nozzle orifice receives print data.

26. The liquid jetting method as set forth in claim 20, wherein the serial drive signals respectively have different liquid jetting energy from each other.

* * * * *